US009662805B2

(12) United States Patent
Uchiyama et al.

(10) Patent No.: US 9,662,805 B2
(45) Date of Patent: May 30, 2017

(54) METHOD OF RESUMING OPERATION OF WIRE SAW

(71) Applicant: SHIN-ETSU HANDOTAI CO., LTD., Tokyo (JP)

(72) Inventors: Atsuo Uchiyama, Tomi (JP); Hisakazu Takano, Nagano (JP); Hitoshi Sejimo, Chikuma (JP); Yukio Hijirisawa, Chikuma (JP); Daisuke Nakamata, Nagano (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 195 days.

(21) Appl. No.: 14/651,524

(22) PCT Filed: Dec. 6, 2013

(86) PCT No.: PCT/JP2013/007181
§ 371 (c)(1),
(2) Date: Jun. 11, 2015

(87) PCT Pub. No.: WO2014/108956
PCT Pub. Date: Jul. 17, 2014

(65) Prior Publication Data

US 2015/0328800 A1 Nov. 19, 2015

(30) Foreign Application Priority Data

Jan. 10, 2013 (JP) ..... 2013-002421

(51) Int. Cl.
*B28D 5/04* (2006.01)
*B24B 27/06* (2006.01)

(52) U.S. Cl.
CPC ..... *B28D 5/045* (2013.01); *B24B 27/0633* (2013.01)

(58) Field of Classification Search
CPC ..... B28D 5/045; B28D 1/08; B28D 1/124; B28D 1/088; B24B 27/0633; B23D 61/185
(Continued)

(56) References Cited

U.S. PATENT DOCUMENTS 2,158,830 A * 5/1939 Newsom ..... B23D 61/185 299/15
3,478,732 A * 11/1969 Clark ..... B23D 57/0053 125/12
(Continued)

FOREIGN PATENT DOCUMENTS

CN 102343632 A 2/2012
JP H04-219211 A 8/1992
(Continued)

OTHER PUBLICATIONS

Jan. 21, 2014 International Search Report issued in International Patent Application No. PCT/JP2013/007181.
(Continued)

*Primary Examiner* — George Nguyen
(74) *Attorney, Agent, or Firm* — Oliff PLC

(57) ABSTRACT

A method of resuming operation of a wire saw in which slicing of a workpiece is suspended due to a wire break, including processes of: imparting axial reciprocating motion to a wire while supplying a new line of the wire; and slicing the workpiece into wafers by moving the workpiece downwardly to press the workpiece against the reciprocating wire while supplying a slicing slurry to the wire, the method includes: repairing the broken wire after suspending the slicing of the workpiece before resuming the slicing of the workpiece; and preparing for the slicing in that a diameter of the repaired wire at a position at which the workpiece is to be sliced is matched to the diameter of the wire just before occurrence of the wire break. The method can inhibit the
(Continued)

formation of grooves in wafers sliced after the resumption and reduce low-quality production wafers.

8 Claims, 6 Drawing Sheets

(58) Field of Classification Search
USPC ..... 125/21
See application file for complete search history.

(56) References Cited

U.S. PATENT DOCUMENTS

| | | | | |
|---|---|---|---|---|
| 6,279,564 | B1 * | 8/2001 | Hodsden | B23D 57/0046 125/16.01 |
| 2010/0163010 | A1 * | 7/2010 | Kitagawa | B24B 27/0633 125/21 |
| 2011/0088678 | A1 | 4/2011 | Kitagawa | |
| 2013/0061841 | A1 * | 3/2013 | Matsumoto | B24B 27/0633 125/21 |
| 2014/0000580 | A1 | 1/2014 | Kitagawa | |
| 2014/0144420 | A1 * | 5/2014 | Wiesner | B28D 5/045 125/16.02 |

FOREIGN PATENT DOCUMENTS

| | | | |
|---|---|---|---|
| JP | H10-249701 | A | 9/1998 |
| JP | 2002-256391 | A | 9/2002 |
| JP | 2006-123055 | A | 5/2006 |
| JP | 2010-069607 | A | 4/2010 |
| JP | 2011-031355 | A | 2/2011 |
| JP | 2012-223862 | A | 11/2012 |
| TW | 201021989 | A | 6/2010 |
| TW | 201223669 | A | 6/2012 |

OTHER PUBLICATIONS

Yoshiaki et al; "Ultra precise wafer surface control technic;" Science Forum Inc.; Feb. 28, 2000.

May 31, 2016 Search Report issued in Chinese Patent Application No. 2013800700394.

Feb. 22, 2016 Search Report issued in Taiwanese Patent Application No. 102145393.

* cited by examiner

METHOD OF RESUMING OPERATION OF WIRE SAW

TECHNICAL FIELD

The present invention relates to a wire saw that slices a workpiece such as a semiconductor ingot by pressing the workpiece against a wire to which a slurry is supplied, and more particularly to a method of resuming operation of the wire saw when the wire is broken.

BACKGROUND ART

Wire saws have been known as means for slicing workpieces such as semiconductor ingots into wafers. A wire saw has a wire row formed by winding a slicing wire around a plurality of grooved rollers multiple times, and is configured to slice a workpiece simultaneously at each wire position by causing the slicing wire to travel in the direction of a wire axis at a high speed and feeding the workpiece toward the wire row while supplying a slurry properly.

FIG. 1 schematically shows an exemplary wire saw.

As shown in FIG. 1, the wire saw 1 has a wire 2 to slice a workpiece W. The wire 2 is unreeled from a wire reel 6 on a supply side and enters a group of grooved rollers 3. The wire 2 is wound around the grooved rollers 3 about 300 to 500 times so as to form the wire row. The wire 2 further exits from the group of grooved rollers 3 and is reeled by a wire reel 6' on a collection side.

When the workpiece W is sliced, axial reciprocating motion having predetermined travel distances is imparted to the wire 2 and a new line of the wire is gradually supplied from the supply side to the collection side.

The amount of wear of the wire wound around the grooved rollers 3 is accordingly larger on the side to which the wire is collected, the collection side, than on the side to which the new line is supplied, the supply side; the diameter of the wire is smaller on the collection side. The thickness of wafers sliced on the collection side is thus apt to be thicker than that of wafers sliced on the supply side.

In view of this, a grooved roller in which intervals between grooves on the collection side are narrower than on the supply side is used (See Patent Document 1).

Incidentally, the wire saw uses a wire composed of a material with high abrasion resistance, high tension resistance, and high hardness such as a piano wire and a grooved roller composed of a resin with prescribed hardness, which prevents damage of the wire. Unfortunately, wear or fatigue of the wire that occurs over time may cause a break in the wire during slicing of a workpiece, making it impossible to continue the slicing of the workpiece.

In this case, after the workpiece fed is disengaged from the wire (a disengage operation), the broken portion of the wire is usually pulled out to a proper position on the outside of one grooved roller by a manual operation or manipulating a grooved roller actuator and the ends of the broken portion are connected. If the broken portion is unusable, this potion is removed and replaced with a new line before the connection. The connected portion of the wire is then pulled again to a position at which the connected portion is not directly involved in the slicing of the workpiece (a pulling operation).

After the wire is repaired in the above manner, each line in the wire row is engaged with a corresponding cut portion of the workpiece (a return operation). The slicing of the workpiece is then resumed to complete the slicing of the workpiece (a restoration operation).

To solve the problem of the break in wires, it is known that wire strength is improved (See Patent Document 2, for example) and when a wire saw detects a symptom of the wire break, slicing is stopped (See Patent Document 3). These technics contribute reduction in the frequency of the wire break.

CITATION LIST

Patent Literature

Patent Document 1: Japanese Unexamined Patent publication (Kokai) No. H10-249701
Patent Document 2: Japanese Unexamined Patent publication (Kokai) No. 2002-256391
Patent Document 3: Japanese Unexamined Patent publication (Kokai) No. 2011-31355

Non Patent Literature

Non Patent Document 1: Ultra precise wafer surface control technic, Matsushita Yoshiaki etc., Feb. 28, 2000, Science Forum Inc.

SUMMARY OF INVENTION

Technical Problem

The break in wires however cannot entirely be prevented because of increased burden of the wires due to recent increase in productivity. Once the wire break occurs, grooves that subsequent processes cannot remove are formed in wafers obtained by resuming slicing of a workpiece, which is expensive, resulting in a large number of inferior goods.

The present inventor investigated the cause of this problem and found the following. When the ends of the broken portion of the wire are connected by the above repair operation and the connected portion is pulled from a position at which the workpiece is to be sliced, a portion of the wire at the workpiece slicing position is replaced with a new line. The diameter of the wire at the workpiece slicing position just after the occurrence of the wire break is smaller than that of the new line because of wear. Thus, the diameter of the wire just before the wire break differs from that of the new line. It is known that the value of a workpiece slicing stock removal is commonly obtained by adding three times the average abrasive grain diameter of a slurry to the wire diameter (See Non Patent Document 1). The increase in the workpiece slicing stock removal after the resumption of the slicing causes the formation of the grooves in cut portions.

In recent years, since a lapping stock removal in a subsequent lapping process is set at a lower level so as to reduce production cost of wafers, there are increasing cases in which the lapping process cannot remove the grooves. If the above grooved roller in which the intervals between the grooves on the collection side are narrower than on the supply side is used, use of the new line reduces the thickness of wafers sliced particularly at a slicing position near the collection side and forms the grooves, which likely fail to be removed.

In addition, as the diameter of the wafers are increased, the effect of produced inferior goods is becoming more and more serious.

The present invention was accomplished in view of the above-described problems. It is an object of the present invention to provide a method of resuming operation of a wire saw that can inhibit the formation of grooves in wafers sliced after the resumption of the operation and reduce low-quality production wafers, even when a workpiece such as a semiconductor ingot is sliced with the wire saw and the slicing is suspended due to a wire break.

Solution to Problem

To achieve this object, the present invention provides a method of resuming operation of a wire saw in which slicing of a workpiece is suspended due to a wire break and then resumed, the operation including processes of: winding a wire around a plurality of grooved rollers; imparting axial reciprocating motion to the wire while supplying a new line of the wire from a supply side to a collection side; and slicing the workpiece into wafers by moving the workpiece relatively downwardly to press the workpiece against the reciprocating wire and to feed the workpiece with the workpiece cut into while supplying a slicing slurry to the wire, the method comprising: repairing the broken wire after suspending the slicing of the workpiece before resuming the slicing of the workpiece; and preparing for the slicing in such a manner that a diameter of the repaired wire at a position at which the workpiece is to be sliced is matched to the diameter of the wire just before occurrence of the wire break.

Such a method of resuming operation can eliminate the difference in diameter between the wire before the break and a wire used after the resumption of the operation, thereby inhibiting the formation of grooves in sliced wafers and the production of inferior product wafers.

The step of preparing for the slicing may include wearing the repaired wire such that the diameter of the repaired wire matches the diameter of the wire just before the occurrence of the wire break if a position of the wire break is located at a position at which the wire is wound around the grooved rollers, or a position on the supply side.

Even when the wire break occurs at the above position and the repaired wire at the workpiece slicing position is replaced with a new line by the repair operation, this method can readily match the diameter of the repaired wire to the diameter of the wire just before the occurrence of the wire break.

The step of preparing for the slicing may include: providing the wire saw with a dummy workpiece and a holding unit configured to hold the dummy workpiece; wearing the repaired wire by slicing the dummy workpiece with the wire such that the diameter of the wire at a position at which the wire exits from the grooved rollers to the collection side matches to the diameter of the wire just before the occurrence of the wire break; and then removing the dummy workpiece and the holding unit.

In this manner, the diameter of the repaired wire can readily be matched to the diameter of the wire just before the occurrence of the wire break on the basis of the wire diameter at the position at which the wire exits from the grooved rollers to the collection side. In addition, the step of preparing for the slicing does not necessarily include detaching the workpiece, of which the slicing is suspended, from the wire saw. This prevents variation in relatively positional relationship between the wire row and the workpiece, thereby preventing the slicing after the resumption of the operation from being affected by the variation in the position of the workpiece.

The step of repairing may include detecting a wire length from a position of a broken portion of the wire when the wire break has occurred to the position at which the wire exits from the grooved rollers to the collection side, and the step of preparing for the slicing may include positioning the wire such that the broken portion of the wire is located at the position at which the wire exits from the grooved rollers to the collection side, and then slicing the dummy workpiece by supplying and using the new line of the wire with a length larger than the measured wire length.

This method can readily determine the length of the new line to be worn and the time for slicing the dummy workpiece and reliably match the diameter of the repaired wire to the diameter of the wire just before the occurrence of the wire break in the minimum processing time.

The diameter of the wire can be measured with a micrometer or a laser displacement meter.

In this manner, the diameter of the wire can readily be measured.

Advantageous Effects of Invention

The present invention involves: slicing a workpiece with a wire saw; when a wire is broken during the slicing, repairing the broken wire; and then matching the diameter of the repaired wire at a position at which the workpiece is to be sliced to the diameter of the wire just before the occurrence of the wire break. The invention can thereby eliminate the difference in diameter between the wire before the break and a wire used after the resumption of the operation, consequently inhibiting the formation of grooves in sliced wafers and improving the flatness of the wafers. This enables the reduction in low-quality production wafers.

DESCRIPTION OF EMBODIMENTS

Embodiments of the present invention will hereinafter be described, but the present invention is not limited to these embodiments.

As described previously, when a wire is broken during slicing of a workpiece with a wire saw, resuming the slicing of the workpiece causes the formation of grooves at resumed slicing portions due to the difference in diameter between the wire just before the break and the repaired wire.

The inventor diligently considered to solve this problem and found the following: after the wire is repaired, the diameter of the repaired wire at the workpiece slicing position is matched to the diameter of the wire just before the occurrence of the wire break; this operation enables the inhibition of the formation of grooves. The inventor thereby brought the invention to completion.

Operation of a wire saw that slices a workpiece into wafers will now be described.

Figure 1:
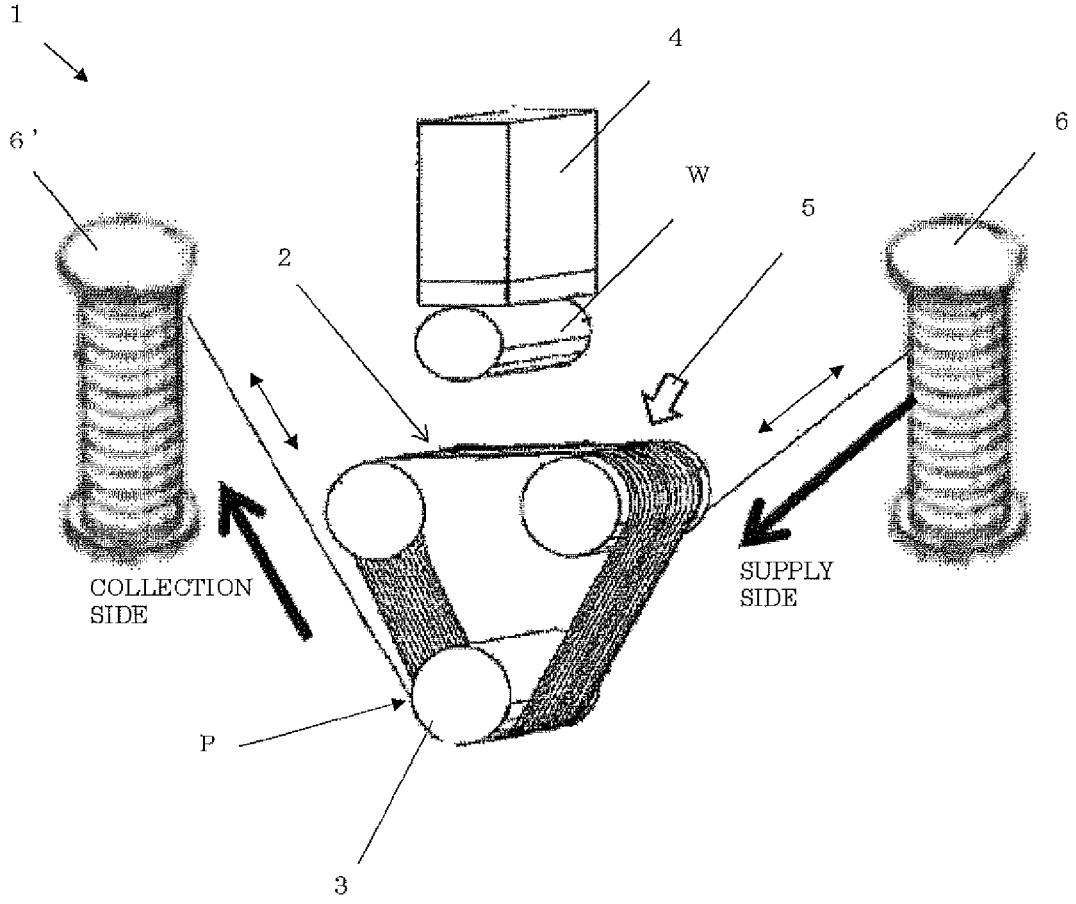
FIG. 1 is a schematic diagram of a typical example of a wire saw.

As shown in FIG. 1, the wire saw 1 includes a wire 2 to slice a workpiece W, grooved rollers 3 around which the wire 2 is wound, a workpiece feeding mechanism 4 configured to move the workpiece W to be sliced relatively downward, and a slurry supplying mechanism 5 configured to supply a slurry to the wire 2 during slicing.

The wire 2 is unreeled from a wire reel 6 on the supply side and enters a group of grooved rollers 3. The wire 2 is wound around the grooved rollers 3 about 300 to 500 times so as to form the wire row. The wire 2 further exits from the group of the grooved rollers 3 and is reeled by a wire reel 6' on the collection side.

A wire-tension-giving mechanism (not shown) configured to apply a tension to the wire 2 is disposed between the grooved rollers 3 and the wire reels 6 and 6'.

When the workpiece W is sliced, axial reciprocating motion having predetermined travel distances is imparted to the wire 2. In the reciprocating motion, the reciprocating wire travels different distances in each direction; thus the travel distance in one direction is larger than in the other direction. This allows a new line of the wire to be gradually supplied in the direction in which the wire travels a longer distance, in other words, the direction from the supply side to the collection side as shown in FIG. 1, while the reciprocating motion of the wire continues.

The workpiece W is held with the workpiece feeding mechanism 4 and fed relatively toward the wire 2 located below the workpiece W. The workpiece feeding mechanism 4 moves the workpiece W relatively downward until the wire 2 reaches a pad plate to press the workpiece W against the wire 2 for infeed. After the slicing of the workpiece W is completed, the direction in which the workpiece W is fed is reversed to extract the workpiece W after slicing from the wire row.

The inventive method of resuming operation of a wire saw is performed when slicing of the workpiece W is suspended due to a break in the wire 2 during the operation of the wire saw and the slicing is resumed. The inventive method will now be described in detail with reference to FIG. 1 and FIG. 2.

When the wire break has occurred, the slicing of the workpiece is suspended. The workpiece is temporarily extracted from the wire row (FIG. 2 at (A)) to remove the broken wire (FIG. 2 at (B)). The wire is then repaired. In addition, the diameter of the wire when the break has occurred is measured (FIG. 2 at (C)). As shown in FIG. 1, the position at which the wire diameter is measured may be the position P (referred to as the collection-side ending point, below) at which the wire exits from the grooved rollers to the collection side.

Figure 2:
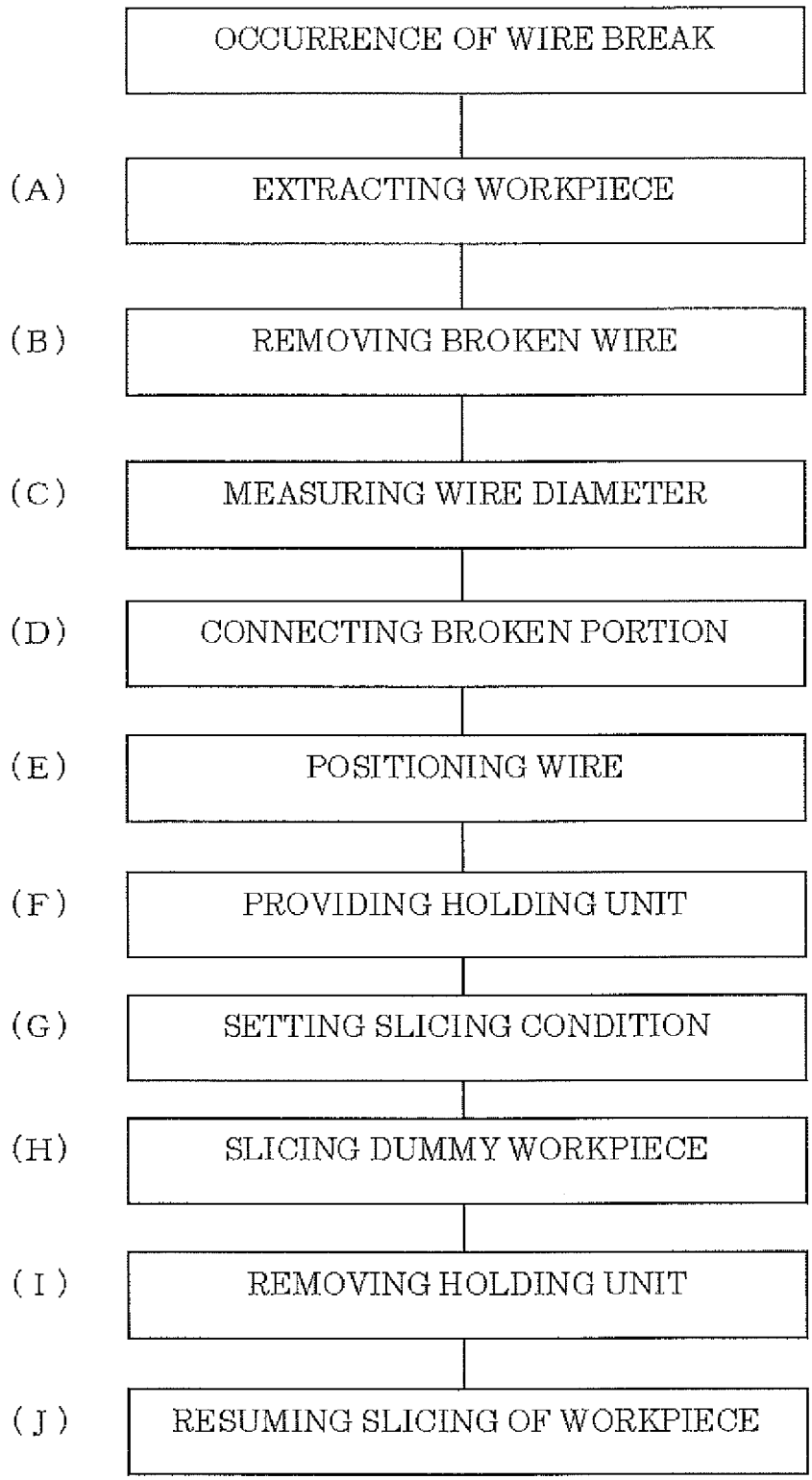
FIG. 2 is a flowchart of a method of resuming operation of a wire saw according to the invention.

If the position of the wire break is located at a position at which the wire is wound around the grooved rollers, or a position on the supply side away from the grooved rollers, the wire is pulled out such that the broken portion of the wire is located on the side of the wire reel 6' away from the collection-side ending point P and the ends of the broken portion of the wire are then connected (FIG. 2 at (D)). This operation can facilitate the repair operation of the wire and prevent the connected portion of the wire from being used when the slicing is resumed, so the quality of sliced wafers can be prevented from being affected by the connected portion. In this case, the reciprocating motion of the wire when the slicing is resumed begins with the direction of the collection side.

If the position of the wire break is located at a position on the collection side away from the grooved rollers, the ends of the broken portion of the wire can be connected without pulling out the wire to the collection side. Alternatively, the wire may be pulled in the direction of the collection side to connect the ends of the broken portion of the wire as required for the repair operation of the wire, for example, when the position of the wire break is too close to the grooved roller.

A slicing preparing operation is then performed to prepare for resuming the suspended slicing of the workpiece. This operation includes matching the diameter of the repaired wire at the workpiece slicing position to the diameter of the wire just before the occurrence of the wire break. Each line in the wire row is then engaged with a corresponding cut portion of the workpiece.

If the position of the wire break is located at a position on the collection side and the ends of the broken portion of the wire are connected without pulling out the wire to the collection side in the repairing operation, the diameter of the wire at the workpiece slicing position after its repair matches to the diameter of the wire just before the occurrence of the wire break. If the wire is pulled out to the collection side, the wire is returned to its pre-pulled position, i.e., to the position just before the occurrence of the wire break for positioning, so that the diameter of the wire at the workpiece slicing position after its repair can be matched to the diameter of the wire just before the occurrence of the wire break.

If the position of the wire break is located at a position at which the wire is wound around the grooved rollers or a position on the supply side, since the broken portion of the wire have been pulled out to the collection side in the above manner, a portion of the wire at the workpiece slicing position after the resumption contains a new line. Thus, this position of the wire at the workpiece slicing position is caused to wear so as to match the wire diameter of this portion to the wire diameter just before the occurrence of the break.

Figure 3:
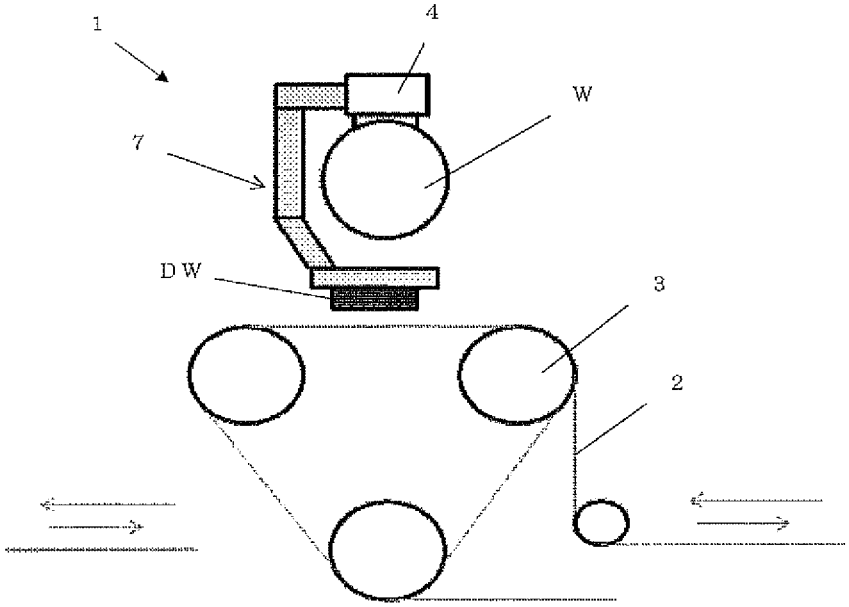
FIG. 3 is a diagram showing the slicing of a dummy workpiece by a method of resuming operation of a wire saw according to the invention.

Specific methods of wearing the wire may include slicing a dummy workpiece with the wire. It is unpreferable to detach the workpiece, of which the slicing is suspended, from the workpiece feeding mechanism because the position of the workpiece may change between before and after the resumption of the slicing. In view of this, as shown in FIG. 3, the wire saw 1 is provided with a dummy workpiece DW and a holding unit 7 configured to hold the dummy workpiece. The holding unit 7, for example, can be detachably provided in the workpiece feeding mechanism 4.

In this manner, the wire can be worn by slicing the dummy workpiece with the wire without detaching the workpiece, of which the slicing is suspended, from the workpiece feeding mechanism 4.

In this operation, whether or not the wire diameter at the workpiece slicing position matches the wire diameter just before the occurrence of the break can be decided according to the wire diameter at the collection-side ending point P. More specifically, the decision that the wire diameter at the workpiece slicing position matches the wire diameter just before the occurrence of the break can be made when the dummy workpiece is sliced such that the wire diameter at the collection-side ending point P matches the wire diameter just before the occurrence of the break.

A specific example of the procedure for wearing the wire by slicing the dummy workpiece with the wire will now be described.

Figure 5:
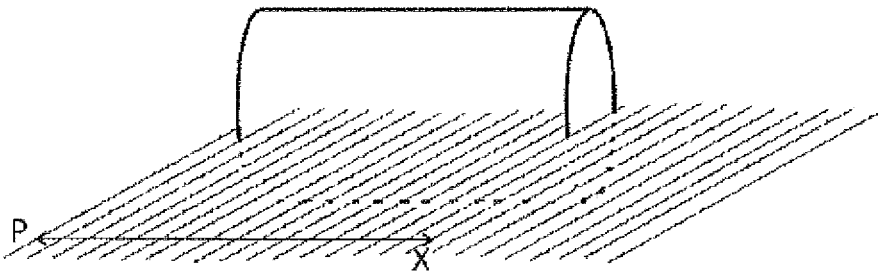
FIG. 5 is a diagram showing the distance X from the collection-side ending point P to the position of the occurrence of a wire break.

In the repairing operation, the wire length C from the position of the broken portion of the wire when the wire break has occurred to the collection-side ending point P is detected. In this detection, the wire length C can be calculated by WN×X/D, if the wire length of one revolution around the grooved rollers is denoted by WN, the distance in the direction perpendicular to the wire row between the collection-side ending point P and the position of the occurrence of the break is denoted by X (See FIG. 5), and the interval between lines of the wire row is denoted by D. In this expression, if the interval between lines of the wire row on the collection side is narrower than on the supply side, its average value is used.

In the slicing preparing operation, the wire is positioned such that the broken portion (connected portion) of the wire is located on the side of the wire reel 6' somewhat away from the collection-side ending point P (FIG. 2 at (E)). The connected portion that is located on the side of the wire reel 6' somewhat away from the collection-side ending point P is in a state of being offset from the collection-side ending point P.

The diameter of the repaired wire at the collection-side ending point P is then measured with a micrometer or a laser displacement meter. The difference ΔQ between this measured value and the wire diameter at the same position when the break has occurred is calculated.

Figure 4:
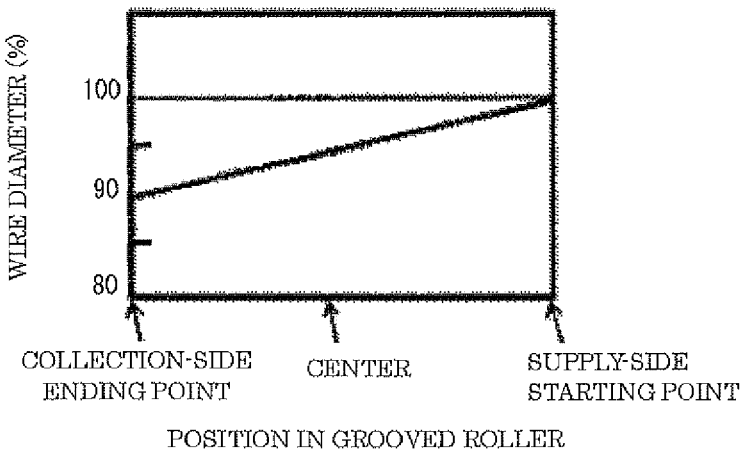
FIG. 4 is a diagram showing variation in wire diameter due to wear depending on the position in a grooved roller.

In general, the new line of the wire supplied from the supply side during slicing of a workpiece gradually advances to the collection side while the reciprocating motion of the wire continues. The diameter of the wire gradually decreases due to its wear as the wire advances to the collection side. As shown in FIG. 4, the wire diameter at the collection-side ending point P is about 10 percent smaller than the diameter of the new line. The decrease in wire diameter due to the wear varies depending on slicing conditions such as a new-line supplying rate, an average wire traveling speed, an infeed rate, and a pressure of the workpiece pressing the wire row. The amount of wear of the wire however always increases as the wire advances from the supply side to the collection side for reasons of the slicing principle of a wire saw. The measured diameter is accordingly larger than the wire diameter at the same position when the break has occurred.

The wire saw is then provided with a dummy workpiece and the holding unit configured to hold the dummy workpiece (FIG. 2 at (F)), and the slicing conditions are set (FIG. 2 at (G)). The dummy workpiece is sliced under these slicing conditions while the wire is caused to reciprocate and the new line is supplied, until the wire diameter at the collection-side ending point P is worn by the calculated difference ΔQ, that is, the wire diameter at this position matches the wire diameter at the same position when the break has occurred (FIG. 2 at (H)). In this slicing, the amount of wear of the wire at the collection-side ending point P is expressed by K×L×V×F/S, where S is the new-line supplying rate, V is the infeed rate, F is the pressure of the workpiece pressing the wire row, L is the length of the dummy workpiece, and K is a proportionality factor.

The slicing conditions under which the dummy workpiece is sliced are accordingly determined so as to satisfy ΔQ=K×L×V×F/S. The slicing conditions that achieve ΔQ can be recorded by previously slicing a dummy workpiece on the basis of this relational expression so that these slicing conditions can be used in the slicing preparing operation. For example, dummy workpieces are previously sliced under conditions of identical dummy-workpiece lengths L, identical infeed rates V, identical pressures F of the dummy workpieces pressing the wire row, and varied new-line supplying rates S to record the relationship between ΔQ and S. In this manner, the new-line supplying rate S corresponding to the target ΔQ can be used in the dummy-workpiece slicing operation.

In addition, the dummy workpiece is sliced by supplying and using the new line of the wire with a length larger than the detected wire length C. This can be achieved by the time T for slicing the dummy workpiece that is equal to or more than a time obtained by the expression of C/S.

After the dummy workpiece is sliced, the wire diameter at the collection-side ending point P is checked and the dummy workpiece and the holding unit are removed (FIG. 2 at (I)).

Examples of the dummy workpiece include a workpiece made of glass, carbon, filled acrylic resin, filled epoxy resin, or filled urethane resin.

After the slicing preparing operation is performed in the above manner, the slicing of the workpiece is resumed (FIG. 2 at (J)).

Example

The present invention will be more specifically described below with reference to an example and a comparative example, but the present invention is not limited to this example.

Example

A silicon ingot having a diameter of 200 mm and a length of 360 mm was sliced with a wire saw as shown in FIG. 1. The wire was broken when the infeed position was 65 mm and the distance X was 25 mm. The slicing of the workpiece was resumed according to the inventive method of resuming operation of a wire saw as follows.

The wire diameter at the collection-side ending point P when the wire break occurred was measured; the diameter was 90% of the diameter of the new line of the wire. After the wire was repaired, the wire was positioned such that the connected portion of the wire was located at the collection-side ending point P.

An acrylic resin dummy workpiece having a thickness of 10 mm, a width of 150 mm, and a length of 360 mm in the holding unit shown in FIG. 3 was then sliced until the wire was worn such that the wire diameter at the collection-side ending point P became 90% of the diameter of the new line of the wire. This operation allowed the diameter of the repaired wire at the workpiece slicing position to match to the wire diameter just before the occurrence of the break.

After the dummy workpiece was sliced, the dummy workpiece and the holding unit were removed. The slicing of the ingot was then resumed to complete the slicing.

The flatness of wafers thus sliced was evaluated. The evaluated wafers were sliced from both ends of the ingot and the center of the ingot. The flatness was evaluated by placing the wafers on a horizontal surface and measuring displacement of one sliced surface in the diameter direction (slicing direction).

Figure 6:
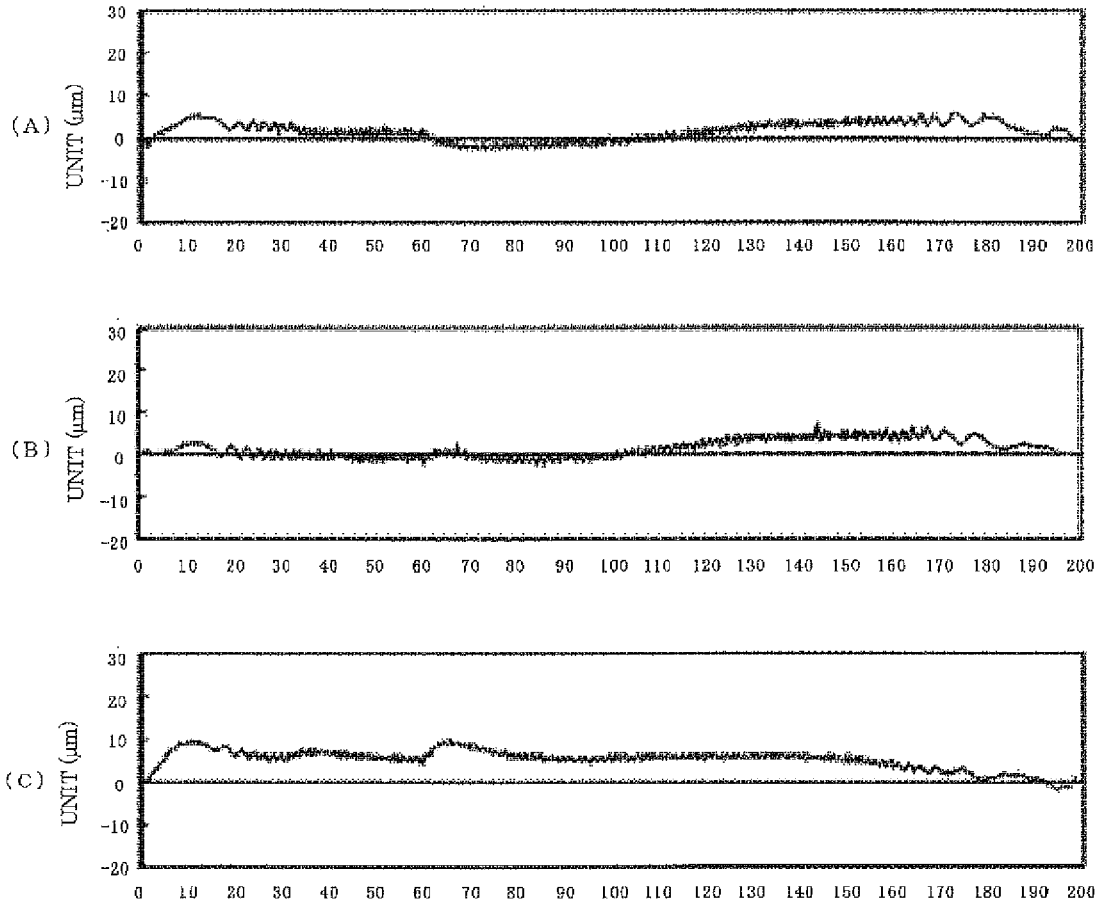
FIG. 6 is a graph of the result of flatness in example.

The result is given in FIG. 6. FIG. 6 shows the result of the wafer located at the end on the supply side at (A), that of the wafer located at the center at (B), and that of the wafer located at the end on the collection side at (C). It can be seen from FIG. 6 that all wafers had no deep groove in the minus direction at the position of the occurrence of the break, 65 mm, and the flatness was thus improved compared with the result of the later-described comparative example. There was no problem about the quality of the obtained wafers as products.

Figure 8:
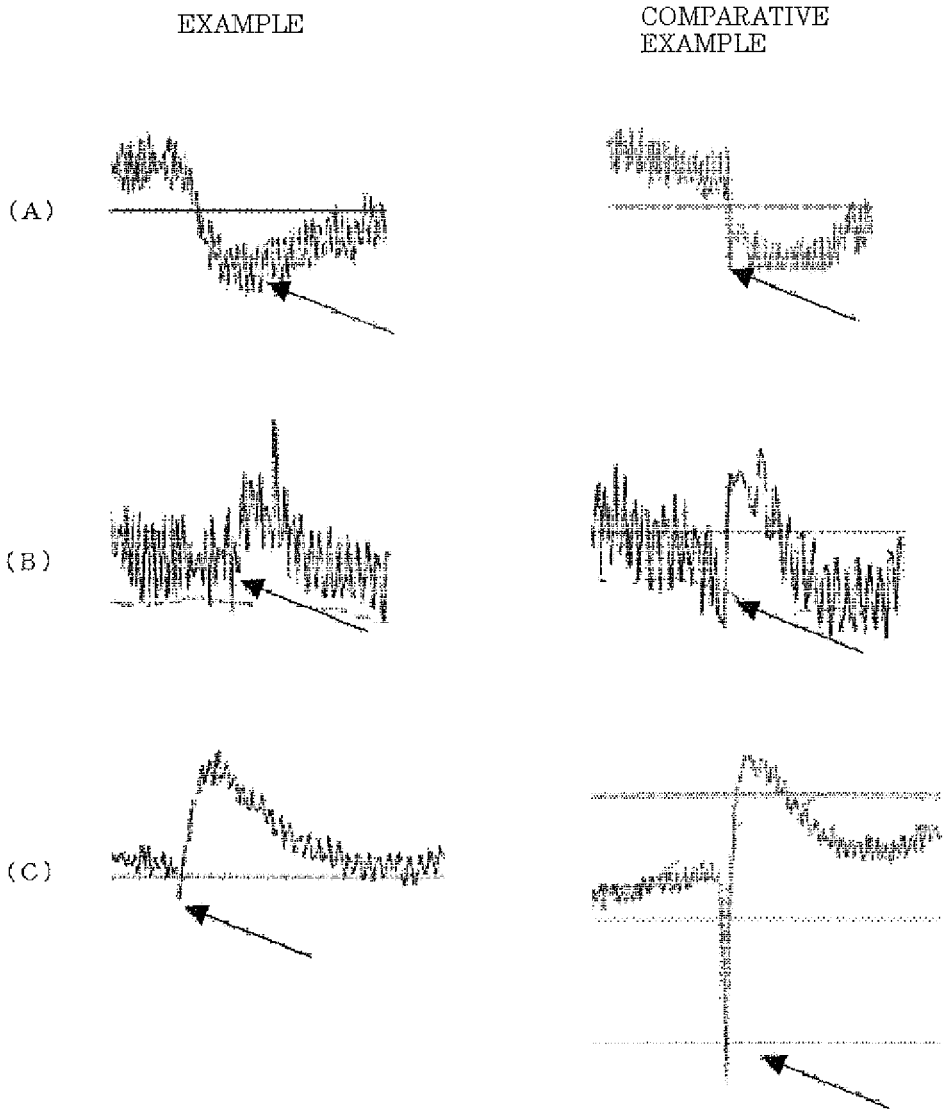
FIG. 8 an enlarged diagram of wire break portions in the results of flatness shown in FIG. 6 and FIG. 7.

FIG. 8 shows an enlarged portion at which the break occurred in wafer flatness shown in FIG. 6. It can be clearly confirmed from FIG. 8 that the formation of grooves was inhibited compared with the later-described comparative example.

Comparative Example

A silicon ingot having a diameter of 200 mm and a length of 365 mm was sliced with a wire saw as shown in FIG. 1. The wire was broken when the infeed position was 85 mm and the distance X was 40 mm. After the wire was repaired, the slicing of the ingot was resumed to complete the slicing without slicing a dummy workpiece, in other words, without matching the diameter of the repaired wire to the wire diameter just before the occurrence of the break.

Figure 7:
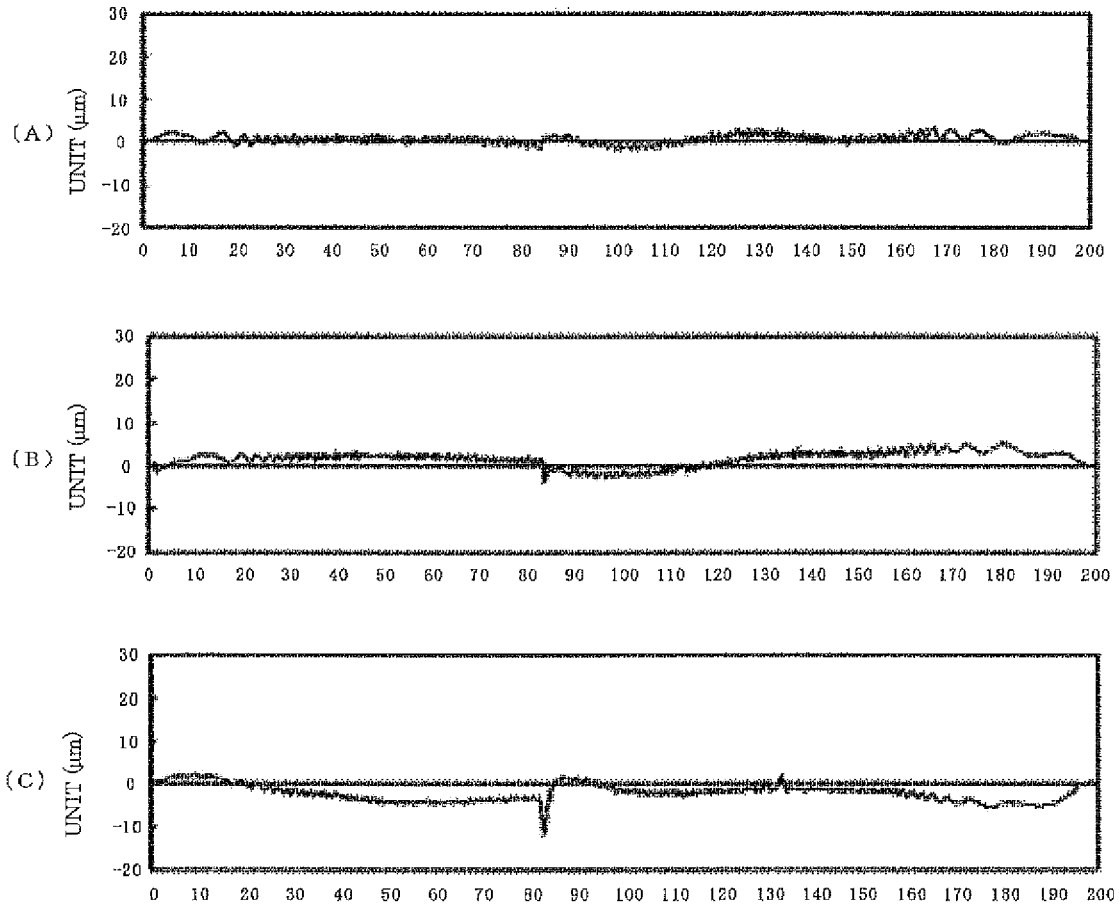
FIG. 7 is a graph of the result of flatness in comparative example.

The flatness of wafers was then evaluated as in example. The result is given in FIG. 7. FIG. 7 shows the result of the wafer located at the end on the supply side at (A), that of the wafer located at the center at (B), and that of the wafer located at the end on the collection side at (C), as in example. As shown in FIG. 7, deep grooves in the minus direction were formed at the position of the occurrence of the break, 85 mm, in the wafer at the center (B) and the wafer at the end on the collection side (C). The depth of these grooves was too great to remove by a subsequent process such as a lapping process, so these wafers were inferior goods.

FIG. 8 shows an enlarged portion at which the break occurred in wafer flatness shown in FIG. 7. It can be clearly confirmed from FIG. 8 that deep grooves that were unremovable by a subsequent process were formed.

It is to be noted that the present invention is not limited to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A method of resuming operation of a wire saw in which slicing of a workpiece is suspended due to a wire break and then resumed, the operation including processes of: winding a wire around a plurality of grooved rollers; imparting axial reciprocating motion to the wire while supplying a new line of the wire from a supply side to a collection side; and slicing the workpiece into wafers by moving the workpiece relatively downwardly to press the workpiece against the reciprocating wire and to feed the workpiece with the workpiece cut into while supplying a slicing slurry to the wire, the method comprising:

repairing the broken wire after suspending the slicing of the workpiece before resuming the slicing of the workpiece; and preparing for the slicing in such a manner that a diameter of the repaired wire at a position at which the workpiece is to be sliced is matched to the diameter of the wire just before occurrence of the wire break.

2. The method of resuming operation of a wire saw according to claim 1, wherein the step of preparing for the slicing includes wearing the repaired wire such that the diameter of the repaired wire matches the diameter of the wire just before the occurrence of the wire break if a position of the wire break is located at a position at which the wire is wound around the grooved rollers, or a position on the supply side.

3. The method of resuming operation of a wire saw according to claim 2, wherein the step of preparing for the slicing includes: providing the wire saw with a dummy workpiece and a holding unit configured to hold the dummy workpiece; wearing the repaired wire by slicing the dummy workpiece with the wire such that the diameter of the wire at a position at which the wire exits from the grooved rollers to the collection side matches to the diameter of the wire just before the occurrence of the wire break; and then removing the dummy workpiece and the holding unit.

4. The method of resuming operation of a wire saw according to claim 3, wherein the step of repairing includes detecting a wire length from a position of a broken portion of the wire when the wire break has occurred to the position at which the wire exits from the grooved rollers to the collection side, and the step of preparing for the slicing includes positioning the wire such that the broken portion of the wire is located at the position at which the wire exits from the grooved rollers to the collection side, and then slicing the dummy workpiece by supplying and using the new line of the wire with a length larger than the measured wire length.

5. The method of resuming operation of a wire saw according to claim 1, wherein the diameter of the wire is measured with a micrometer or a laser displacement meter.

6. The method of resuming operation of a wire saw according to claim 2, wherein the diameter of the wire is measured with a micrometer or a laser displacement meter.

7. The method of resuming operation of a wire saw according to claim 3, wherein the diameter of the wire is measured with a micrometer or a laser displacement meter.

8. The method of resuming operation of a wire saw according to claim 4, wherein the diameter of the wire is measured with a micrometer or a laser displacement meter.

* * * * *